US007069989B2

(12) United States Patent
Marmorshteyn et al.

(10) Patent No.: US 7,069,989 B2
(45) Date of Patent: Jul. 4, 2006

(54) METHOD OF INCREASING PRODUCTIVITY AND RECOVERY OF WELLS IN OIL AND GAS FIELDS

(76) Inventors: Leon Marmorshteyn, 1500 Marina Vista #408, San Mateo, CA (US) 94404; James Franklin, 3510 Santoro Way, San Diego, CA (US) 92103

( * ) Notice: Subject to any disclaimer, the term of this patent is extended or adjusted under 35 U.S.C. 154(b) by 0 days.

(21) Appl. No.: 10/861,002

(22) Filed: Jun. 7, 2004

(65) Prior Publication Data

US 2005/0269098 A1 Dec. 8, 2005

(51) Int. Cl.
*E21B 43/267* (2006.01)

(52) U.S. Cl. ..... 166/250.1; 166/308.1

(58) Field of Classification Search ..... 166/279, 166/280.2, 308.1, 250.1
See application file for complete search history.

(56) References Cited

U.S. PATENT DOCUMENTS

| | | | | |
|---|---|---|---|---|
| 4,977,961 | A * | 12/1990 | Avasthi | 166/297 |
| 5,025,859 | A | 6/1991 | Hanson et al. | 166/252.1 |
| 5,111,881 | A * | 5/1992 | Soliman et al. | 166/250.1 |
| 5,565,624 | A * | 10/1996 | Deboaisne et al. | 73/152.02 |

* cited by examiner

*Primary Examiner*—William Neuder
(74) *Attorney, Agent, or Firm*—I. Zborovsky

(57) ABSTRACT

A method of increasing productivity and recovery of wells in oil and gas fields includes determining a direction of maximal horizontal stresses, producing at least two wells so that they are spaced from one another in a direction corresponding to the direction of the maximum horizontal stresses, forming in at least one of the wells at least one vertical slot oriented substantially from the at least one well to the other of the wells, and introducing a hydrofracturing fluid at least into the at least one well to produce a hydraulic fracture in direction from the at least one well to the other well.

12 Claims, 1 Drawing Sheet

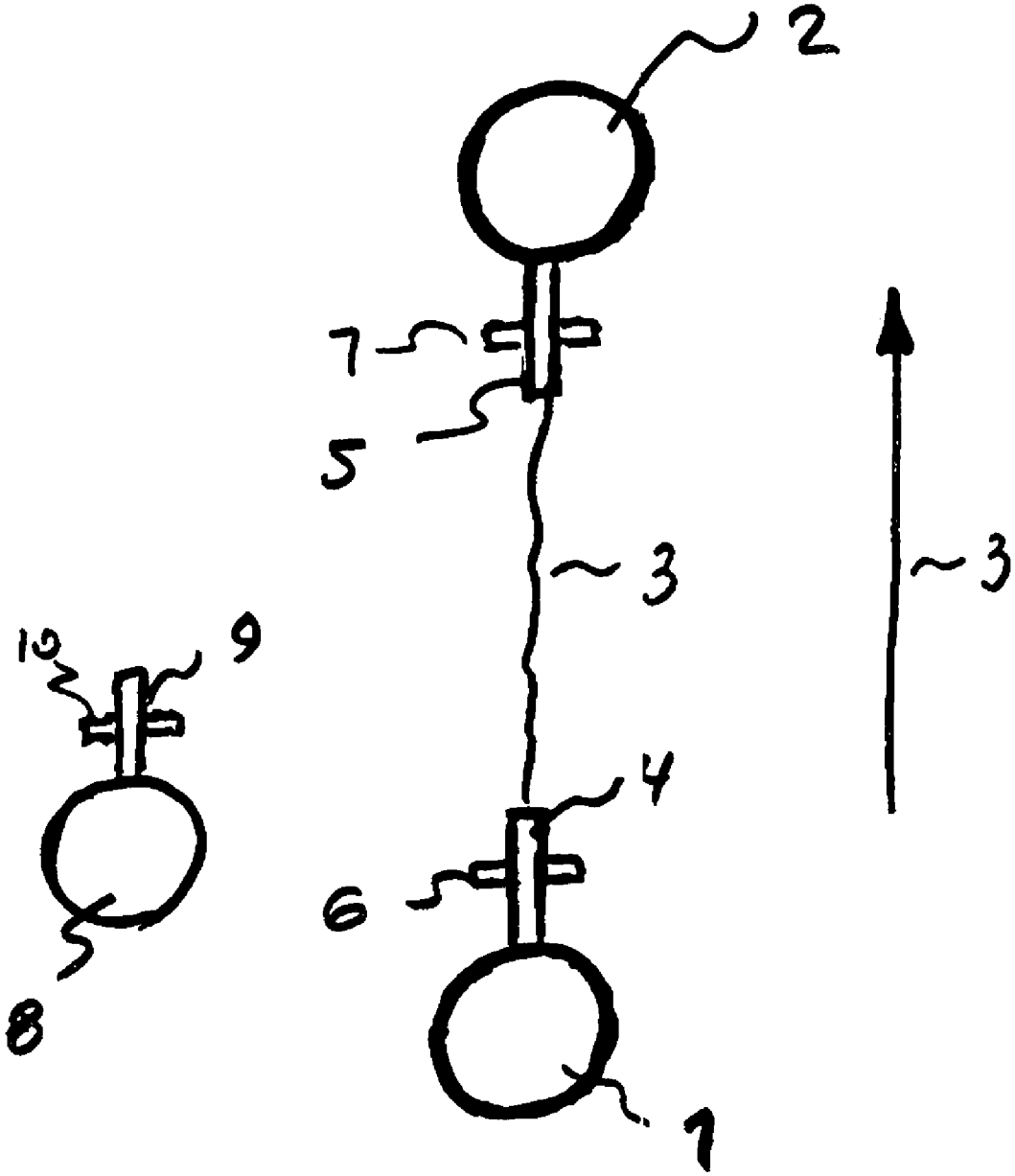
2
7
5
3
3
10
9
4
6
8
1

METHOD OF INCREASING PRODUCTIVITY AND RECOVERY OF WELLS IN OIL AND GAS FIELDS

BACKGROUND OF THE INVENTION

The present invention relates to a method of increasing productivity and recovery of wells in oil and gas fields.

Method of the above-mentioned general type are known. A method of hydraulic fracture of underground layers for formation of horizontal slots is known, as disclosed for example in U.S. Pat. No. 3,965,982. In this method upper and lower packers are installed in a well opposite to the layer in contact with a surface of the layer.

Another method for increasing permeability of productive layers is based on introduction of clay wedging agent into a fluid, as disclosed in U.S. Pat. No. 3,976,138.

A further method is used for producing hydraulic fracture in productive layers with the use of viscous solutions of surface-active substances, as disclosed for example in U.S. Pat. No. 4,007,792. With this method a pressure in the well is increased to a value causing formation of cracks in the rock, and the pressure is maintained between 0.5 and 6 hours. The pressure is then reduced, and the material is removed from the well.

Also, a method of multiple fracturing of underground layers is known, in which in order to fracture the layer which is opened by a well, a working fluid is pumped through the well into the layer, and a particulate wedging material is introduced into the cracks. Then a working fluid is pumped through the well into the layer until the layer is fractured, and the particulate wedging material is introduced into the newly formed crack. This method is disclosed in U.S. Pat. No. 3,998,271.

A further method of "wedging" of cracks in productive layers includes introduction of a viscous fluid, so that the hardenable fluid penetrates into the cracks and is retained in them. Then the introduction of the viscous fluid is stopped so that the crack remains open until the hardenable fluid hardens and spreads the crack. This method is disclosed in U.S. Pat. No. 4,029,149.

Finally, a method for fracturing of productive layers by means of an acid foam is known as well. In accordance with this method a gel-like solution having a certain pressure and containing a surface active substance and an inert gas is introduced for forming slots in the layer. This method is disclosed in U.S. Pat. No. 4,044,833. Other methods are known as well.

The known methods are based on the concept of creating a hydraulic connection between a productive layer and a group of layers in a well through a low-permeable or practically impermeable near-well zone which is characterized by increased concentrations of stresses. Even if the near-well zone in the area of a productive layer does not have a poor permeability, the use of hydrofracturing not always leads to positive results. As a rule, the direction of the hydrofracturing changes along the layer, which leads to connection of the layer with water-carrying horizons and stops an industrial flow of oil/gas. In this case it is also not possible to connect simultaneously several wells for performing corresponding works.

SUMMARY OF THE INVENTION

Accordingly, it is an object of the present invention to provide a method of increasing productivity and recovery of wells in oil and gas fields, which is an improvement of the existing methods.

In keeping with these objects and with others which will become apparent hereinafter, one feature of the present invention resides, briefly stated, in a method of increasing productivity and recovery of wells in oil and gas fields, comprising the steps of determining a direction of maximal horizontal stresses; producing at least two wells so that they are spaced from one another in a direction corresponding to the direction of the maximum horizontal stresses; forming in at least one of the wells at least one vertical slot oriented substantially from said at least one well toward the other of the wells; and introducing a hydrofracturing fluid at least into said least one well to produce a hydraulic fracture in direction from said at least one well toward said other well.

When the method is performed in accordance with the present invention, a significantly improved interaction of two wells is provided and therefore the productivity and recovery of the wells in gas and oil fields is increased.

In accordance with a further feature of the present invention, slots are formed in two wells and they are directed toward one another, and in particular in direction of the maximum horizontal stresses, and the hydrofracturing fluid is introduced in both wells, which further improves the efficiency of the method.

In accordance with still a further feature of the present invention, additional vertical slots are provided so as to extend substantially perpendicular to the first mentioned slots, with a length corresponding to a part of the length of the above mentioned first main slots, so as to increase a draining surface in the well without affecting the stress condition created by the first mentioned slots.

In accordance with still a further feature of the present invention the method further includes analyzing a plurality of layers; and performing the formation of the slots in a layer which is most efficient for compensating expenses for the slot formation. Therefore, all the expenses related to the process are compensated in the shortest possible time.

In accordance with still a further feature of the present invention, the method includes forming a slot with a slot forming medium; and supplying the slot-forming medium with a maximum pressure producible by an equipment located on a ground. It has been found that when the cutting of slots is performed, (contrary to a universally accepted principle using a pressure calculated in correspondence with the required criteria for cutting,) with a maximum pressure allowed by the equipment, it further increases the productivity.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a plan view schematically illustrating a method of increasing productivity and recovery of wells in oil and gas fields, in accordance with the present inventions.

DESCRIPTION OF THE PREFERRED EMBODIMENTS

In a method of increasing productivity and recovery of wells in oil and gas fields in accordance with the present invention, a hydraulic fracture in a corresponding layer is utilized. In the inventive method first a direction of maximum horizontal stresses is determined. For this purpose, for example, a well 1 is first drilled, and the direction of maximum horizontal stresses can be determined by detecting density of rock which surrounds the well around an axis of the well. The maximum horizontal stress is determined as $$\delta max = ymax.h,$$

wherein ymax is a maximum density of the rock determined in a corresponding point around the circumference of the well 1, and h is a depth of the layer.

A second well 2 is then drilled. The second well 2 is made at the location such that the well 2 is spaced from the well 1 in a direction which correspond to the direction of the maximum horizontal stresses 3.

In at least one of the wells, for example in the well 1, a vertical slot 4 is then formed. The slot 4 is formed so that it is oriented toward the second well 2, or in other words in a direction substantially corresponding to the direction of the maximum horizontal stress.

The slot 4 is cut by one of the known methods, for example by means of a hydraulic sand blasting perforation. A packer with a hydraulic anchor is then placed. A fluid for hydrofracturing is pumped in a space under the packer through corresponding pipes. The moment of the hydrofracture and occurrence of breaking with generation of cracks is determined by reduction of pressure in the system in condition of a constant supply of the pumping fluid. After the hydraulic fracturing, a fluid which carries sand with a binding material is pumped through the pipes, and then a pressing fluid with a volume equal to the volume of the pipes is pumped as well. The hydrofracturing fluid easily overpowers the destroyed zone of increased permeability.

With the inventive method, the work for breaking of the layer and formation of cracks starts beyond the limits of this zone, so that a distance between the wells can be increased. The pressure for the hydrofracturing can be significantly reduced, since the rock is additionally loaded by the maximum horizontal stresses, and in order to provide their extreme condition and their destruction a significantly lower additional action of pressure of the hydrofracturing fluid is needed.

In accordance with a further feature of the present invention, another slot 5 is formed in the second well 2 as well. It is formed so that it is directed toward the well 1 or in other words also in the direction of maximum horizontal stresses. The slot 5 can be produced similarly to the slot 4. The formation of the second slot 5 additionally improves the orientation of the direction of the hydrofracturing exactly between the wells 1 and 2. The supply of the fluids in the well 2 can be performed in the same manner as the supply of the corresponding fluids in the well 1. The operations in the wells 1 and 2 can be performed successively one after the other. In accordance with a preferable embodiment of the present invention, however the operations for providing hydrofracturing in both wells 1 and 2 can be performed simultaneously.

In accordance with another feature of the present invention, when the hydrofracturing is performed from the well 1, the pressure in the well 2 is depressed. This further increases the efficiency of the hydrofracturing.

In accordance with a further feature of the present invention a hydrofracturing is performed in a layer which is the most efficient for compensation of expenses required for the hydrofracturing. For example, first analysis is performed to evaluate the efficiency of the corresponding layers. Saturation of the layers with oil/gas and capacity of oil/gas in the layers is determined. Based on this determination a layer having a maximum saturation with oil/gas and a maximum oil/gas capacity is selected. Then, the above mentioned hydrofracturing works are performed in the thusly selected layer.

In the hydrofracturing process it has been a long standing concept to select a pressure of the fluid supplied for hydrofracturing in accordance with the parameters of the corresponding layer, in which hydrofracturing is to be performed. In accordance with the present invention, in departure from the long standing concept it, is proposed to supply the hydrofracturing fluid with the maximum pressure which can be achieved by the equipment located on the ground. Therefore, the efficiency of the hydrofracturing is significantly improved.

In the inventive method of increasing productivity and recovery of wells in oil and gas fields, in accordance with another embodiment, it is proposed to form additional slots. As shown in the drawings, one additional slot 6 is formed substantially transverse or perpendicular to at least the slot 4 of the well 1. The slot 6 have a length substantially corresponding to 20–50% of the length of the slot 4. The slot 6 is formed so as to increase a draining surface. The slot 6 can be formed in the same manner as the slot 4.

Substantially similar slot 7 can be formed in the area of the slot 5 of the well 2. It can have the same length as the slot 6.

It should be mentioned that the slots 4, 5, 6, 7 are cut over the depth corresponding to the efficient thickness of the corresponding layer.

In accordance with a further feature of the present invention, another well or other wells can be drilled in the same area, as identified with reference numeral 8. A slot 9 can be then cut from the well 8 (with a slot 10), also in a direction corresponding to the direction of the maximum horizontal stresses. When the hydrofracturing fluid is then introduced into the well 8, the hydrofracturing is also performed in a predetermined direction corresponding to the direction of maximum horizontal stresses. This hydrofracture from the well 8 can reach the area of influence of other wells, thus providing corresponding interactions of the wells.

It will be understood that each of the elements described above, or two or more together, may also find a useful application in other types of methods differing from the types described above.

While the invention has been illustrated and described as embodied in a method of increasing productivity and recovery of wells in gas and oil fields, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of increasing productivity and recovery of wells in oil and gas fields, comprising the steps of determining a direction of maximal horizontal stresses; producing at least two wells so that they are spaced from one another in a direction corresponding to the direction of the maximum horizontal stresses; forming in at least one of the wells at least one vertical slot oriented substantially from said at least one well to the other of the wells; introducing a hydrofracturing fluid at least into said at least one well to produce a hydraulic fracture in a direction from said at least one well to said other well; and further comprising analyzing a plurality of layers; and performing the production of the wells and formation of the slot in a layer-which has a greatest saturation with oil or gas, and a greatest capacity of oil or gas.

2. A method as defined in claim 1; and further comprising orienting said at least one slot in said direction of said maximum horizontal stresses.

3. A method as defined in claim 1; and further comprising forming in said other well another slot which is oriented from said other well toward said at least one well.

4. A method as defined in claim 3, and further comprising orienting said other slot in said direction of said maximum horizontal stresses.

5. A method as defined in claim 3; and further comprising introducing the hydrofracturing fluid also in said other well so as to produce hydraulic fracturing also in a direction from said other well toward said one well as well.

6. A method as defined in claim 3; and further comprising introducing a hydrofracturing fluid into said wells successively one after the other.

7. A method as defined in claim 3; and further comprising introducing hydrofracturing fluids into said wells simultaneously so as to provide hydrofracturing simultaneously from two wells towards one another.

8. A method as defined in claim 1; and further comprising generating a depression of pressure in the other of said wells.

9. A method as defined in claim 1; and further comprising introducing a corresponding fluid for hydrofracturing exclusively into said at least one well.

10. A method as defined in claim 1; and further comprising producing at least one additional well; and forming in said additional well at least one additional slot extending in a direction substantially corresponding to the direction of maximum horizontal stresses.

11. A method of increasing productivity and recovery of wells in oil and gas fields, comprising the steps of determining a direction of maximal horizontal stresses; producing at least two wells so that they are spaced from one another in a direction corresponding to the direction of the maximum horizontal stresses; forming in at least one of the wells at least one vertical slot oriented substantially from said at least one well to the other of the wells; introducing a hydrofracturing fluid at least into said at least one well to produce a hydraulic fracture in a direction from said at least one well to said other well; and further comprising forming at least one additional slot which is oriented substantially perpendicular to said first mentioned slot and has a length substantially corresponding to 20–50% of a length of said first mentioned slot.

12. A method of increasing productivity and recovery of wells in oil and gas fields, comprising the steps of determining a direction of maximal horizontal stresses; producing at least two wells so that they are spaced from one another in a direction corresponding to the direction of the maximum horizontal stresses; forming in at least one of the wells at least one vertical slot oriented substantially from said at least one well to the other of the wells; introducing a hydrofracturing fluid at least into said at least one well to produce a hydraulic fracture in a direction from said at least one well to said other well, wherein said forming of the slot includes forming the slot with a slot forming medium; and supplying the slot-forming medium with a maximum pressure producible by an equipment located on a ground.

* * * * *